United States Patent [19]

Allison

[11] 4,388,836

[45] Jun. 21, 1983

[54] PUMPING MECHANISM

[76] Inventor: William D. Allison, 39 Randor Cir., Grosse Pointe Farms, Mich. 48236

[21] Appl. No.: 228,285

[22] Filed: Jan. 26, 1981

[51] Int. Cl.[3] ..... F16H 21/32

[52] U.S. Cl. ..... 74/41

[58] Field of Search ..... 74/40, 41; 267/25, 57

[56] References Cited

U.S. PATENT DOCUMENTS

| | | | |
|---|---|---|---|
| 116,186 | 6/1871 | Hershey | 267/57 |
| 157,813 | 12/1874 | Griffith | 267/57 |
| 938,966 | 11/1909 | Byrnes | 74/41 |
| 1,891,552 | 12/1932 | McCrosky | 74/41 |
| 2,078,480 | 4/1937 | Burks | 74/41 |
| 3,150,869 | 9/1964 | Birney | 267/57 |

*Primary Examiner*—Henry Jaudon

*Attorney, Agent, or Firm*—Fisher, Gerhardt, Crampton & Groh

[57] ABSTRACT

A mechanism for reciprocating heavy loads such as pile drivers or pumping mechanism for deep wells in which the load to be reciprocated vertically is counterbalanced through a pair of swinging arms each of which has a pair of hair-pin type torsion springs and in which the arms are joined together through a linkage and connected to the load to be reciprocated to convert the arcuate swinging movement of the arms to vertical movement of the load.

8 Claims, 7 Drawing Figures

10
12
14
16
20
22
24
26
28
30
32
34
36
40
46
64
66
68
70
74
2
3
4

50
56
58
60
26
28

12
30
34
35
36
38
40
42

30
50
56
62
64

PUMPING MECHANISM

This invention relates to pumping mechanisms for deep wells and particularly to reciprocating pump mechanisms of the type adapted for pumping in oil fields.

Pumping mechanisms used in oil fields are arranged so that the weight of the reciprocating lifting rods and the column of fluid are counter-balanced through a rocking beam by weights. Since the requirements for such machines can be a capacity to lift as much as 50 thousand pounds through a range of as much as 12 feet, the counter-balance weight likewise must be enormous. The weights lifted and the counter-balance weights require very sturdy supporting structures and large powerful sources of power to reciprocate or rock the beam. Also such devices operate by utilizing the forces of gravity and therefore are limited in their speed of operation.

It is an object of the invention to provide a pumping mechanism in which the weight of the lifting rods and the column of fluid to be lifted are counter-balanced by a resilient spring system.

Another object of the invention is to provide a pumping mechanism in which the power requirements for reciprocating the load which includes the column of liquid are at a minimum.

Still another object of the invention is to provide a pumping mechanism in which the speed of operation is not limited by the force of gravity.

Another object of the invention is to provide a pumping mechanism in which the load capacity of the mechanism is adjustable.

The objects of the invention are accomplished by a pumping mechanism wherein a lift member is supported relative to a base member for a vertical reciprocating movement and is adapted for connection to a vertically movable pump rod. The lift member is reciprocated by a pair of arms supported on the base member and the ends of the arms are drilled together by a link member, an intermediate point of which is pivotally connected to the lift member so that the swinging movement of the arms is transmitted into vertical movement to the pump rod. The pump rod and the column of liquid surrounding it are counterbalanced by pairs of hair-pin type torsion springs connected to the pair of arms and to the base member with each of the springs comprising a U-shaped member with parallel torsion bar leg members terminating in oppositely extending foot portions which are anchored to the arms and to the base member. The counter-balanced arms are oscillated in unison to reciprocate the lift member by a power means such as a small electric motor connected to one of the lift arms through a crank and connecting rod.

These and other objects of the invention will become apparent from the following description and from the drawings in which.

A pumping mechanism for oil wells is designated generally at 10 and is for the purpose of reciprocating a lifting rod often called a sucker or polished rod 12 together with a column of liquid from great depths in the earth.

Figure 1:
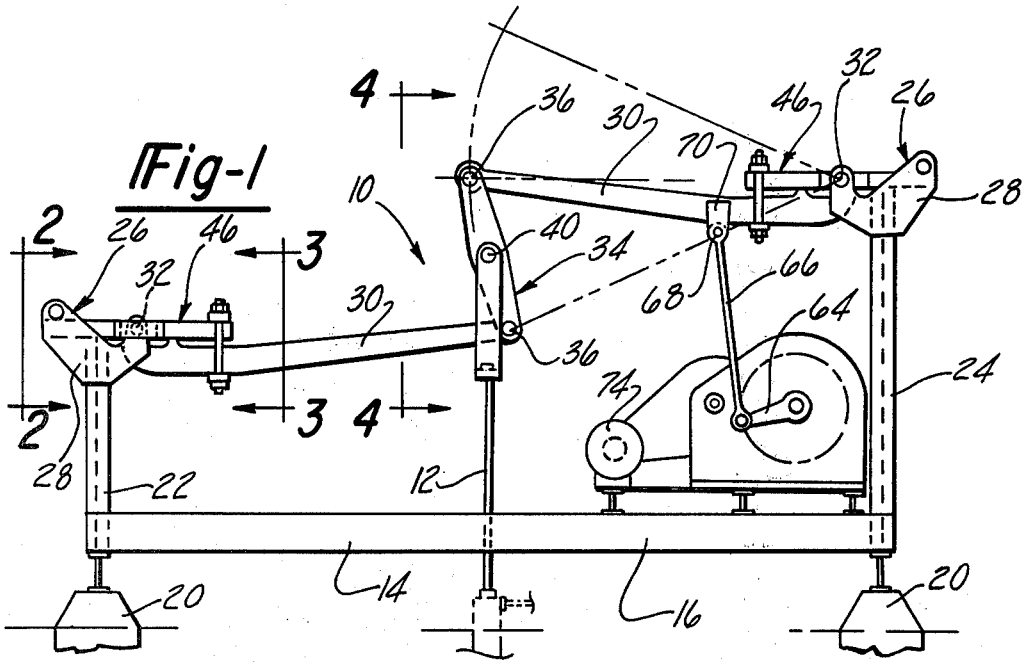
FIG. 1 is a side elevation of the pumping mechanism embodying the invention.
Figure 5:
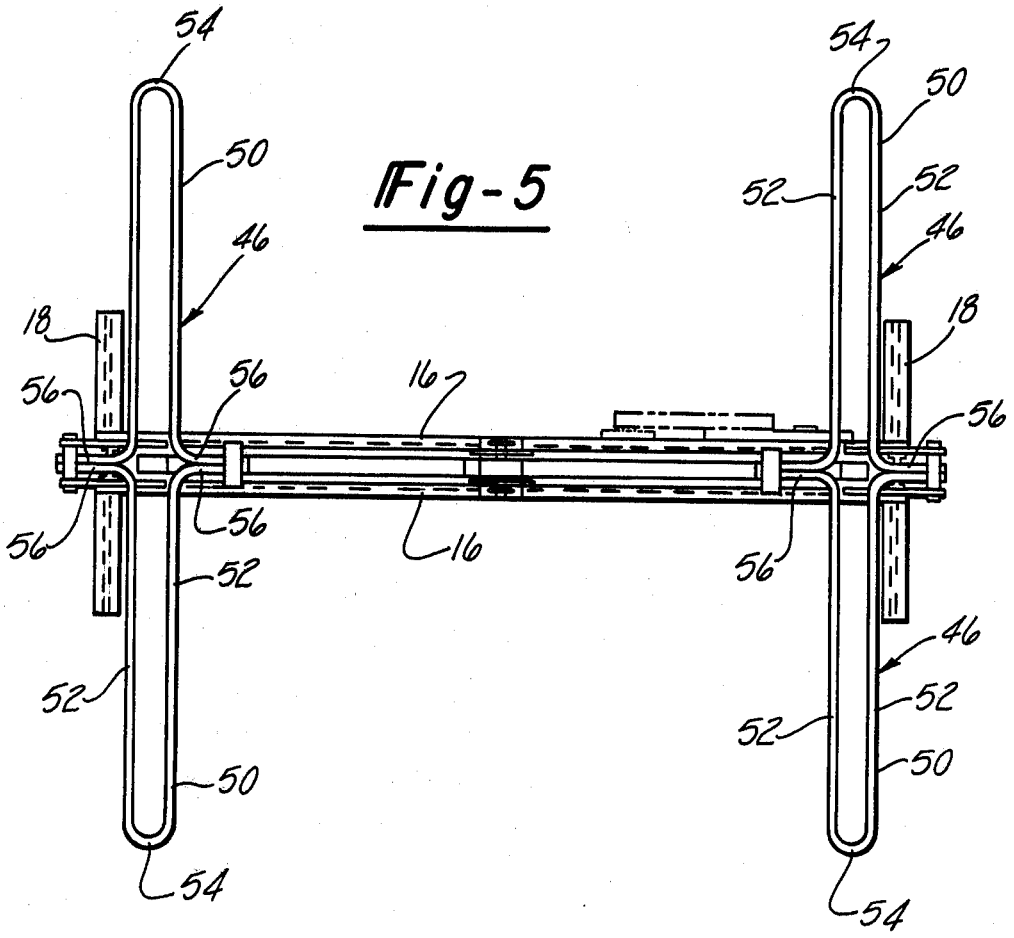
FIG. 5 is a plan view of the pumping mechanism seen in FIG. 1.

The pumping mechanism 10 includes a base member 14 which as seen in FIGS. 1 and 5 can be a pair of parallel elongated beams 16 having opposite ends fastened to shorter transverse I-beams 18 supported relative to the ground on foundation structures 20. Opposite ends of the base 14 are provided with vertically extending posts 22 and 24 in the form of I-beams having their lower ends rigidly fastened between the parallel beams 16.

The upper ends of each of the posts 22 and 24 are provided with a bracket structure 26 and made up of a pair of plates 28 disposed in parallel relationship to each other at opposite sides of the I-beams forming the posts 22 and 24. The bracket structures 26 each pivotally support a pair of identical lift arms 30.

The lift arms 30 each have one end pivotally supported for swinging movement about a pivot pin 32 opposite ends of which are attached to the plates 28. The swinging ends of the lift arms 30 are connected to the opposite ends of a link assembly 34. The link assembly 34 includes a pair of link elements 35 disposed at opposite sides of each of the lift arms 30 and joined together by pivot pins 36 which pass through the ends of the lift arms 30. At a point midway between the pivot pins 36 a yoke 38 is fastened to the link assembly 34 for pivotal movement about a pin 40. The lift rod 12 is shown connected to the yoke 38 by nuts 42 on the threaded end of lift rod 12. During unitary swinging movement of the lift arms 30, the link assembly 34 and yoke 38 form a Watts linkage by which the lift rod 12 is moved in a substantially vertical path by way of lift arms 30, the ends of which swing in arcuate paths.

Figure 6:
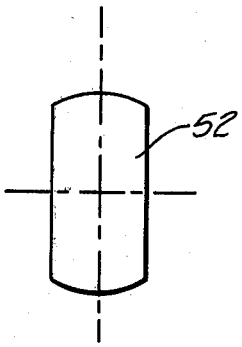
FIG. 6 is a cross-sectional view at a greatly enlarged scale taken on line 6—6 in FIG. 5.

During vertical reciprocating motion of the lift rod 12, the load of the lift rod 12 and the liquid in the well casing are counter-balanced by a pair of spring systems designated generally at 46 and associated with the pair of arms 30, respectfully. Each of the spring systems 46 includes a pair of identical hairpin type torsion springs 50. As best seen in FIG. 5, each of the torsion springs 50 is of a generally U-shaped configuration having a pair of parallel legs 52 joined together by a bight portion 54. The free ends of the leg portions 52 terminate in opposed foot portions 56 which extend in opposite directions from each other. The torsion springs 50 actually are of a combined torsion and bending type and preferably are formed with a uniform cross-section as illustrated in FIG. 6. The cross-section is generally rectilinear with the vertical height of the cross section being approximately two times that of the horizontal width.

Figure 2:
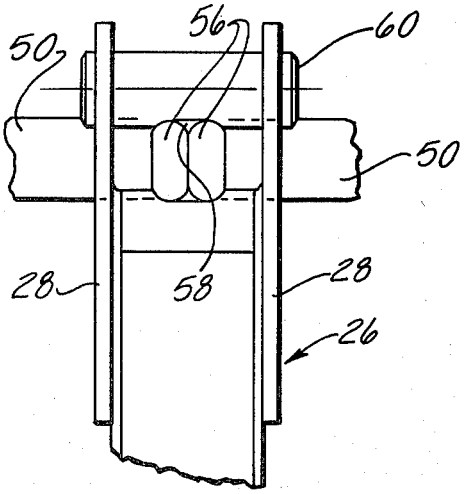
FIG. 2 is a view at an enlarged scale taken generally on line 2—2 in FIG. 1.
Figure 4:
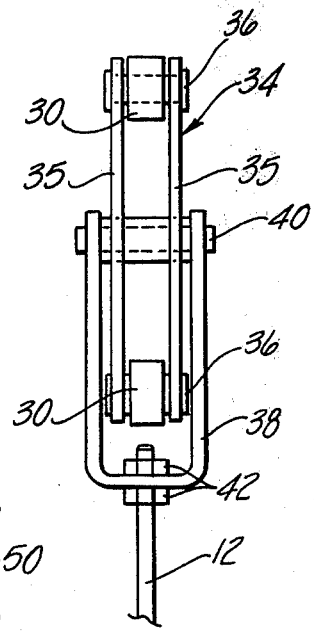
FIG. 4 is a view taken generally on line 4—4 in FIG. 1.
Figure 3:
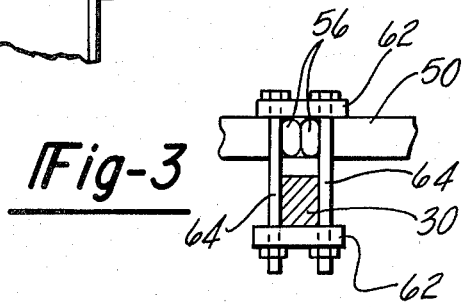
FIG. 3 is a cross-sectional view at a smaller scale taken on 3—3 in FIG. 1.

The pair of springs 50 making up of each of the spring systems 46 are anchored relative to the base 14 and relative to the lift arms 30 as best seen in FIGS. 2, 3, and 5. Each of the spring systems 46 is made up of a pair of the torsion springs 50 which extend in opposite directions from each other so that the foot portions 56 are in abutting relationship with each other. The foot portions 56 are anchored to the base 14 and specifically to the bracket assemblies 26 as shown in FIGS. 1 and 2. A pair of portions 56 of a pair of adjacent springs 50 are disposed between the plates 28 and are held in abutting engagement with each other by placement in engagement with each other in a notch 58 in the surface of a seat element 60 which extends between the plates 28.

The other pair of foot portions 56 of each pair of springs 50 is fastened to a lift arms 30 at a point spaced from their pivot pin 32 as best seen in FIGS. 1 and 3. The feet 56 are held in abutting relationship to each other and are clamped relative to the lift arms 30 by a pair of cleat elements 62 joined together by a pair of bolts 64 disposed at opposite sides of the arm 30. The tension of the bolts 64 may be adjusted to vary the spring load imposed on the lift arms 30.

Figure 7:
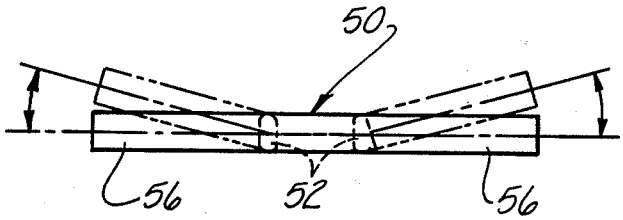
FIG. 7 is an end view of one of the spring members used in the pumping mechanism.

In the process of manufacture of the springs 50, the foot portions 56 are displaced from the horizontal as viewed in FIG. 7 showing the spring in an unloaded condition. In their mounted condition, the springs 50 act to support the maximum expected load transmitted through the lift rod 12. Preferably, the balanced condition of the spring and load would be met slightly above the position illustrated in FIG. 1.

The means by which the arms 30 are moved includes a rotating crank arm 64 connected through a rod 66 to a pivot point 68 on a saddle 70 fixed to one of the lift arms 30. The crank arm 64 can be rotated through a gear reduction driven by a relatively small electric motor 74.

In order to put the various dimensions and requirements in perspective an example of a pump mechanism such as that shown in FIG. 1 for lifting a rod load of 32000 pounds would have an overall dimension as viewed of approximately 24 feet and would be capable of operating through a stroke of approximately 100 inches. The arms 30 would each have a length of approximately 10 feet. The requirement for power to initiate oscillation of the lift rod 12 and to maintain oscillation during the pumping cycles can be as low as five horsepower to oscillate the balanced load at a desired frequency.

Adjustment to the desired stroke can be accomplished by moving the saddle 70 relative to the pivot 32. Also, as mentioned above, the spring force can be adjusted by varying the tension of the bolts 64 at the lift arms 30.

The torsion spring 50 are a combination of torsion and bending springs with torsion stresses occuring in the straight portion of the foot elements 56 and at the midpoint of the bight 54. Intermediate points between these locations are subject to a combination of bending and torsion stresses. The spring balanced load characteristics of this design enables the beginning of pumping action with a much lower torque requirement then is needed to start movement of the massive counter-balance weights used in conventional pumping mechanism. In addition, the resonant frequency of the present spring balance system is considerably higher then in weight counter-balanced systems in present use, thereby permitting faster operation.

It will be seen that a pump mechanism has been provided in which the load to be lifted during the pumping action is counter-balanced by a unique spring system which afford simple construction and allows adjustment of load capability, length of stroke, and cycle speed, all with the requirement of a minimum amount of energy input.

Also it should be noted that the mechanism can be used for reciprocating loads in applications other than in pumping operations. For example, the arrangement would work as well for reciprocating loads vertically in pile driving operations or for breaking up old pavement for replacement by new pavement.

The embodiments of the invention in which an exclusive property or privilege is claimed are defined as follows:

1. A mechanism for reciprocating loads vertically comprising: a base member, a load member supported relative to said base member for vertical reciprocating movement, a pair of arms supported on said base member for vertical swinging movement in a common plane, a link member having opposite ends pivotally connected to corresponding ends, respectively of said pair of arms for vertical translational movement, said load member being pivotally connected to said link member for movement therewith, a pair of hairpin torsion springs connected to each arm and to said base member to counter-balance said load member, each of said springs comprising a U-shaped member having a pair of generally parallel torsion bar leg members and foot portions extending in opposite directions from the free ends of said leg members, one foot portion of each of said springs of a pair of springs being anchored to each arm and the other foot portion of each pair of springs being anchored to said base with said U-shaped member of each pair of springs extending in opposite directions, and power means connected to one of said arms for oscillating said pair of arms in unison to reciprocate said lift member.

2. The mechanism for reciprocating loads vertically according to claim 1 wherein said springs have a uniform cross section and wherein the vertical dimension of said cross section is larger than the horizontal dimension of said cross section.

3. The mechanism for reciprocating loads vertically according to claim 2 wherein said vertical dimension of said cross section is about two times the horizontal dimension.

4. A mechanism for reciprocating loads vertically comprising: a base member, a load member supported relative to said base member for vertical reciprocating movement, an arm supported on said base member for vertical swinging movement, a pair of hairpin torsion springs connected to said arm and to said base member to counter-balance said load member, each of said springs comprising a U-shaped member having a pair of generally parallel torsion bar leg members and foot portions extending horizontally in opposite directions from the free ends of said leg members, one foot portion of both of said springs being anchored adjacent to each other and to said arm and the other foot portion of both of said springs being adjacent to each other and anchored to said base and said U-shaped members extending horizontally in opposite directions from said foot members, and power means connected to said arm for oscillating said arm to reciprocate said load member.

5. The mechanism for claim 4 wherein the cross section of said torsion spring member is substantially uniform throughout its length and is of a vertical dimension larger than its horizontal dimension when said parallel leg members are lying in a substantially horizontal plane.

6. The mechanism of claim 5 wherein the vertical dimension is about two times the horizontal dimension.

7. A mechanism according to claim 6 wherein said foot members are disposed at an angle to each other and at an angle to a plane passing through said legs of said torsion spring when the latter is in a relaxed condition.

8. A mechanism according to claim 6 wherein said foot members are anchored to said lift arm through means adjustable longitudinally of said arm and adjacent foot members to vary the spring load transferred to said arm.

* * * * *